US010276947B2

(12) United States Patent
Acien Fernandez

(10) Patent No.: US 10,276,947 B2
(45) Date of Patent: Apr. 30, 2019

(54) ELECTRICAL CONTACT

(71) Applicant: SIMON, S.A.U., Barcelona (ES)

(72) Inventor: Jonatan Acien Fernandez, Barcelona (ES)

(73) Assignee: SIMON, S.A.U., Barcelona (ES)

( * ) Notice: Subject to any disclaimer, the term of this patent is extended or adjusted under 35 U.S.C. 154(b) by 0 days.

(21) Appl. No.: 16/066,937

(22) PCT Filed: Dec. 19, 2016

(86) PCT No.: PCT/EP2016/081716
§ 371 (c)(1),
(2) Date: Jun. 28, 2018

(87) PCT Pub. No.: WO2017/114681
PCT Pub. Date: Jul. 6, 2017

(65) Prior Publication Data

US 2019/0020126 A1 Jan. 17, 2019

(30) Foreign Application Priority Data

Dec. 28, 2015 (EP) ..... 15382667

(51) Int. Cl.
*H01R 4/48* (2006.01)
*H01R 4/2441* (2018.01)
*H01R 4/2445* (2018.01)

(52) U.S. Cl.
CPC ..... *H01R 4/2441* (2013.01); *H01R 4/2445* (2013.01)

(58) Field of Classification Search
CPC ..... H01R 13/18; H01R 13/112; H01R 13/68; H01H 85/202
USPC ..... 439/839, 857, 620.26, 250
See application file for complete search history.

(56) References Cited

U.S. PATENT DOCUMENTS 1,847,689 A * 3/1932 Gribbie ..... H01R 11/12 439/883
1,874,593 A * 8/1932 Olson ..... H01R 9/18 439/883
4,983,133 A * 1/1991 Van Scyoc ..... H01R 11/12 439/860
5,664,972 A * 9/1997 Zinn ..... H01R 13/113 439/839

(Continued)

FOREIGN PATENT DOCUMENTS

DE 1928058 U 12/1965
DE 202008007330 U1 9/2008

(Continued)

OTHER PUBLICATIONS

International Search Report and Written Opinion dated Feb. 17, 2017 for PCT/EP2016/081716.
IPRP dated Mar. 13, 2018 for PCT/EP2016/081716.

*Primary Examiner* — Phuong Chi T Nguyen
(74) *Attorney, Agent, or Firm* — Lucas & Mercanti, LLP

(57) ABSTRACT

The electrical contact for electrical cables comprises a base (1) and at least one cutting and connection element (2), the or each cutting and connection element (2) defining an initial cutting edge (3) and a cutting and connection portion (4) and is characterized in that said initial cutting edge (3) is closer to the base (1) than said cutting and connection portion (4).

8 Claims, 5 Drawing Sheets

(56) References Cited

U.S. PATENT DOCUMENTS

| | | | | |
|---|---|---|---|---|
| 2006/0040555 | A1* | 2/2006 | Chen | H01R 24/60<br>439/607.01 |
| 2013/0090009 | A1* | 4/2013 | Zhao | H01R 13/44<br>439/607.01 |

FOREIGN PATENT DOCUMENTS

| | | | |
|---|---|---|---|
| FR | 2819348 | A1 | 7/2002 |
| FR | 2921763 | A1 | 4/2009 |

* cited by examiner

ELECTRICAL CONTACT

CROSS REFERENCE TO RELATED APPLICATION

This Application is a 371 of PCT/EP2016/081716 filed on Dec. 19, 2016, which, in turn, claimed the priority of European Patent Application No. 15382667.2 filed on Dec. 28, 2015, both applications are incorporated herein by reference.

The present invention relates to an electrical contact for electrical cables which allows the cover of the electrical cable to be cut more comfortably and with a reduced cutting path.

BACKGROUND OF THE INVENTION

Electrical cables comprise a nucleus formed by an electrical conductor, normally of copper or aluminum and an electrically insulated cover. To connect the electrical cable to an electrical device, for example to a switch, a plug, etc. it is necessary to cut said cover and reach to the nucleus in order to be able to carry out the electrical connection with the electrical device.

At present, electrical contacts are known which comprise cutting and connection elements such that the cable is held and connected. In said electrical contacts, the cable is introduced into the electrical contact in an initial position, where the cover of the cable is begun to be cut and the cable continues a path where the cover continues to be cut until it is completely cut, reaching the nucleus. The holding and connection of the conductor to an electrical device, for example to a switch or a plug, is enabled here.

These conventional electrical contacts have the drawback that the cutting force thereof is increasing or constant, that is to say, in the initial position thereof, less or equal force is applied than during the entire cutting path of the cover of the cable until reaching the nucleus.

This drawback has two consequences, firstly, the path which the cable plots in order to allow the complete cutting of the cover is excessively long and furthermore it is more uncomfortable for the user who connects the electrical cable since they have to apply a large force during the entire cutting path of the cable.

FR2921763A1, DE1928058U and FR2819348A1 disclose an electrical contact according to the preamble of claim 1. Therefore, the need to provide an electrical contact of this type is evident where the cutting of the cover is carried out more comfortably and with a shorter cutting path.

DESCRIPTION OF THE INVENTION

Using the electrical contact of the invention, the cited drawbacks are resolved, having other advantages which will be described below.

The electrical contact according to the present invention comprises a base and at least one cutting and connection element, the or each cutting and connection element defining an initial cutting edge and a cutting and connection portion and is characterized in that said initial cutting edge is closer to the base than said cutting and connection portion.

It should be indicated that in the present description and in the claims, using the term "base", a surface which absorbs and transmits the forces and/or tensions coming from the cutting and connection element is indicated and using the term "cutting and connection element", an element is indicated which carries out the cutting of the cover of the electrical cable and once the cutting has been carried out and arrives at the nucleus, the electrical connection is carried out. According to the embodiment depicted in the figures, each cutting and connection element comprises an arm and a cutting edge.

The or each cutting and connection element is preferably joined to the base by means of said arm, which, can advantageously be elastic owing to the material used in the construction thereof or owing to the design of the same such that the or each cutting and connection element can be moved slightly to be adapted to the cutting force exerted by the user or to avoid disconnections due to external agents such as vibrations.

Preferably, there are two cutting and connection elements and they are paired together, that is to say, placed with the cutting edges thereof opposed to each other or with a small separation between them, the cutting of the cover of the electrical cable being carried out by means of said two edges. Evidently, if it is so desired, there can be more than two cutting and connection elements, preferably in pairs.

In this way, the process of cutting the cable is optimized, implementing greater force at the time where more force is needed, at the beginning in order to start to break the cover, and reducing the force to be exerted during the process of continuing to cut the cover. This decreasing force for cutting the cable allows, at the time of the connection, for there to be greater elasticity in the system and for the cutting path to be less than with the conventional connectors of this type.

Furthermore, when the cable is separated from the base, the force exerted by the contact on the nucleus of the conductor reduces, as a result, when there is a larger lever arm, the contact in the final position thereof works with a tension lower than the initial tension, at a much more elastic limit. In this way, small vibrations or pulls can be absorbed without altering the connection pressure between the contact and the nucleus of the conductor.

According to some embodiments, in particular in those in which a rotary cutting movement is carried out, the or each cutting and connection element define a plane which forms an acute angle with said base, that is to say, this plane defined by the pair of cutting and connection elements is oblique with respect to the base, allowing a tangential cut of the cover of the electrical cable. In an optimal manner, in these types of rotary cuts, the or each cutting element defines a curve to consistently carry out the cut perpendicular to the axial direction of the cable, achieving a cleaner cut and with less distance.

Furthermore, the initial cutting edge preferably comprises a mouth.

Furthermore, the or each cutting and connection element can comprise a knurling which improves the adherence of the cover of the electrical cable with respect to the electrical contact itself, with the corresponding improvement in the action of cutting the cover.

According to a first embodiment, with a novel structure and which also principally works with bending force, it is a contact which proceeds from a sheet which is initially folded over itself forming a U section where the base is the central part and each arm emerges from the same; with the particularity that on the end part of the arms, a second folding is carried out on each one, achieving an edge normal to the base and wherein the cutting and connection element is on normal edge which is also opposed to that of the other arm; in this way if the conductor to be connected is introduced from the part closest to the base and it is displaced in a direction opposed to the base, a contact with decreasing force is also provided.

According to a second embodiment, it is a "C" type electrical contact which principally works with bending forces, it is a contact whose section has a similar shape to a "C" with the ends opposing, which, in the center of the section, is provided with the base and from which at both sides the arms emerge to be opposed at the end. Said arms are joined to a cutting and connection element by the edge thereof which is opposed to the other arm and this cutting and connection element, instead of having a parallel height to the base, is provided with a height oblique to the same so that in this way, the entry of the cable is provided in the part closest to the base and the cutting and connection is carried out in the direction opposed to the base, obtaining a system of decreasing force; being distinguished from the rest of the blades of the same type in that they are provided with both cutting and connection elements parallel to the base and thus working during the process with a constant force.

According to a third embodiment, it is a "blade" type electrical contact which principally works with torsion forces, it is a flat contact, a sheet type, which at one of the ends thereof comprises a base which is joined to both arms which extend in the direction to the side opposed to the base and in that said arms are separated from each other by a groove passing from the base and wherein each arm is joined to a cutting and connection element and said cutting and connection elements are opposed on the faces with less thickness of the arms; it is distinguished from the rest of the blades of the prior art due to the fact that it is provided with a through hole in the area which separates the base from the two arms which carry out the mouth function of the conductor to be connected and with the cutting and connection process in the direction opposed to the base, achieving a decreasing force during said process; a process which is completely different to the one existing today since the entry of the cable is carried out from the end opposed to the base and the cutting and connection process is carried out in the direction to the base.

According to one embodiment of the electrical contact according to the present invention, said mouth is a hole for introducing the electrical cable to be connected.

BRIEF DESCRIPTION OF THE DRAWINGS

In order to better understand what has been stated, drawings are enclosed, in which, schematically and only by way of non-limiting example, a practical embodiment is depicted.

DESCRIPTION OF PREFERRED EMBODIMENTS

Figure 1:
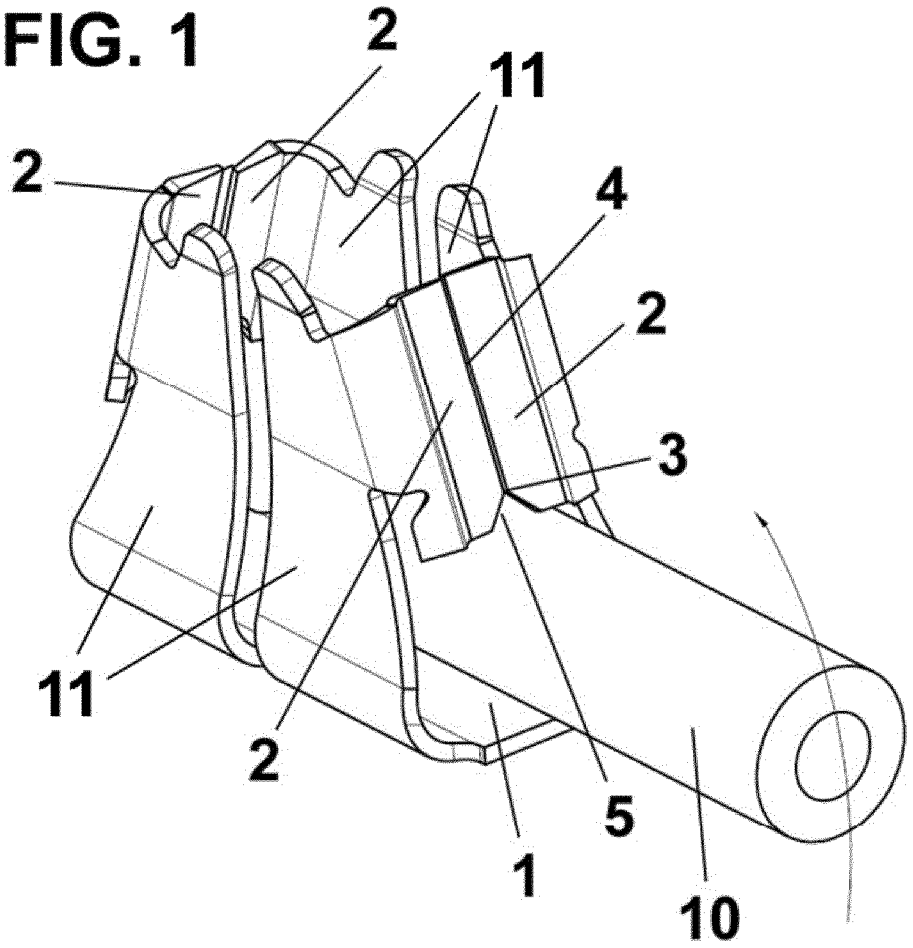
FIG. 1 is a perspective view of a first embodiment of the electrical contact according to the present invention with the cable in the initial cutting position thereof.
Figure 2:
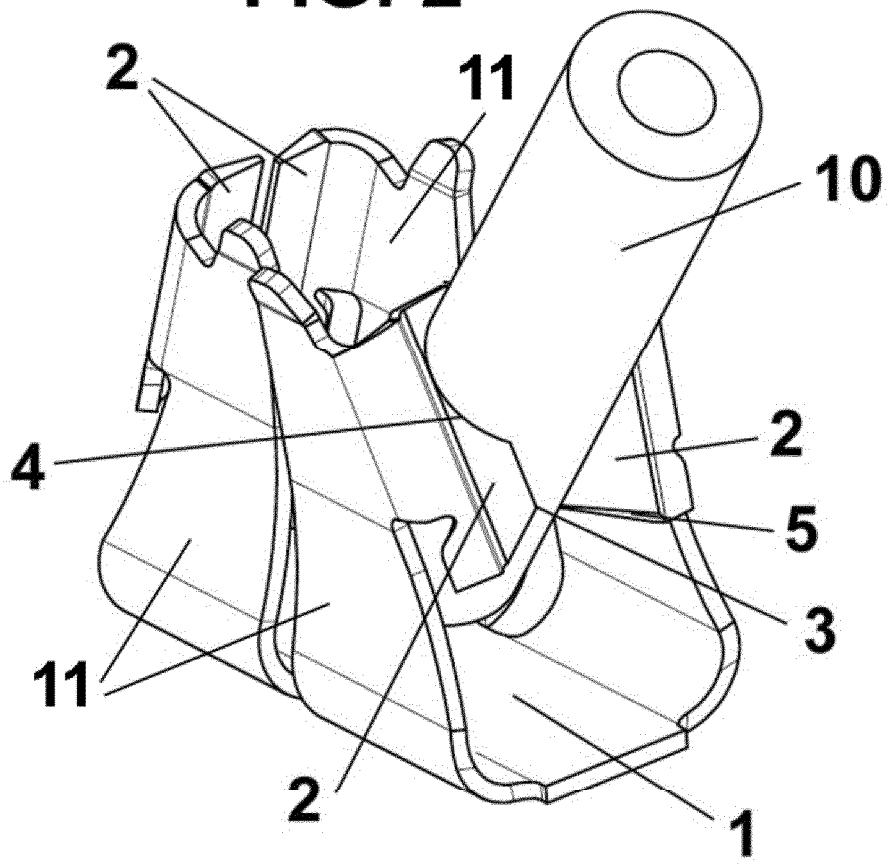
FIG. 2 is a perspective view of a first embodiment of the electrical contact according to the present invention with the cable in the holding and connection position thereof.

In FIGS. 1 and 2, a first embodiment of the electrical contact for electrical cables according to the present invention is depicted.

According to this embodiment, the electrical contact comprises a base (1) which is a substantially flat surface which serves to support the electrical contact.

Said electrical contact also comprises two cutting and connection elements (2), although it could only comprises one cutting and connection element (2), which are placed substantially opposing each other as can be observed in the figures. If it is so desired, the interior edges of each pair of cutting and connection elements (2) can be slightly displaced with respect to each other, as is shown in FIGS. 1 and 2.

Furthermore, according to the embodiment depicted in FIGS. 1 and 2, the electrical contact comprises two arms (11) which extend from the base (1) defining a U shape and a cutting and connection element (2) extends from each arm (11) towards the interior of the electrical contact, preferably from the part furthest from the base (1) of each arm (11) and in a substantially perpendicular manner.

In order to facilitate the tilting movement of the arms (11) with respect to the base (1), these arms (11) preferably have an arched shape.

Each cutting and connection element (2) defines an initial cutting edge (3) and a cutting and connection portion (4) such that the initial cutting edge (3) is arranged closer to the base than the cutting and connection portion (4), thereby providing a decreasing cutting force as has been previously described.

The initial cutting edge (3) is the edge which first contacts the electrical cable (10) when the cutting of the cover of the cable is started, while the cutting and connection portion (4) is the portion where the electrical cable (10 is placed in the final connection position thereof as is shown in FIG. 2.

As is evident, from the initial cutting edge (3) to the cutting and connection portion (4), there is a section along which the cutting of the cover of the electrical cable (10) is carried out and on the cutting and connection portion (4) the cover has been completely cut and the connection is created with the nucleus of the electrical cable (10).

In this embodiment depicted in FIGS. 1 and 2, the movement of the electrical cable (10) from the initial cutting edge (3) to the cutting and connection portion (4) is rotation as has been depicted by means of the arrow of FIG. 1.

Furthermore, according to this embodiment, the initial cutting edge (3) is associated with a mouth (5) for the placement of the electrical cable (10).

Furthermore, the or each cutting and connection element (2) also comprises a knurling which improves the adherence of the cover of the electrical cable with respect to the electrical contact itself with the corresponding improvement in the action of the cutting of the cover due to the fact that it is adhered to the contact and helps to break the possible plastic fibers of the cover of the electrical cable (10) better.

The cutting and connection elements (2) in this example define a plane which forms an acute angle with the base (1), that is to say, said cutting and connection elements (2) are oblique with respect to the base (1), providing a short tangent.

Figure 3:
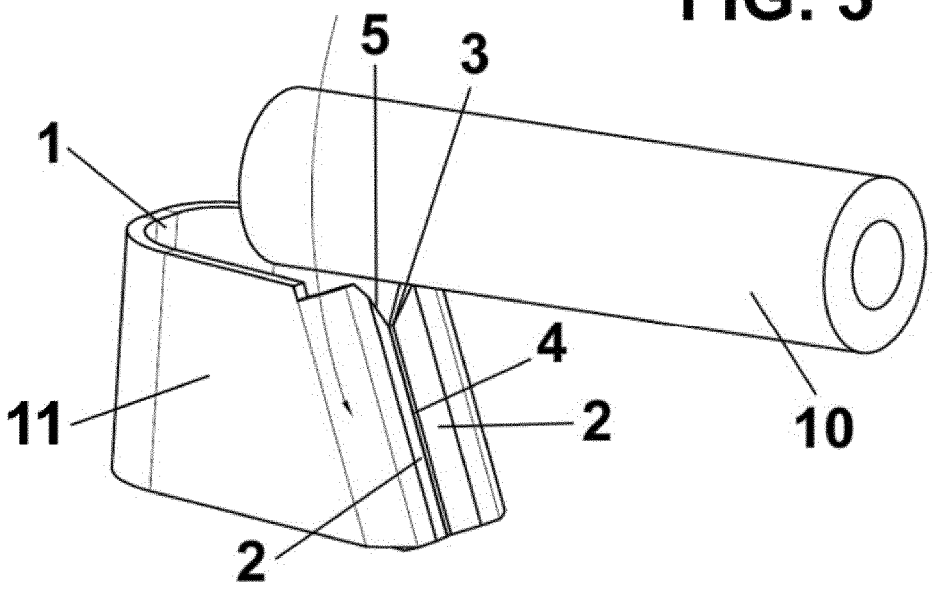
FIG. 3 is a perspective view of a second embodiment of the electrical contact according to the present invention with the cable in the initial cutting position thereof.
Figure 4:
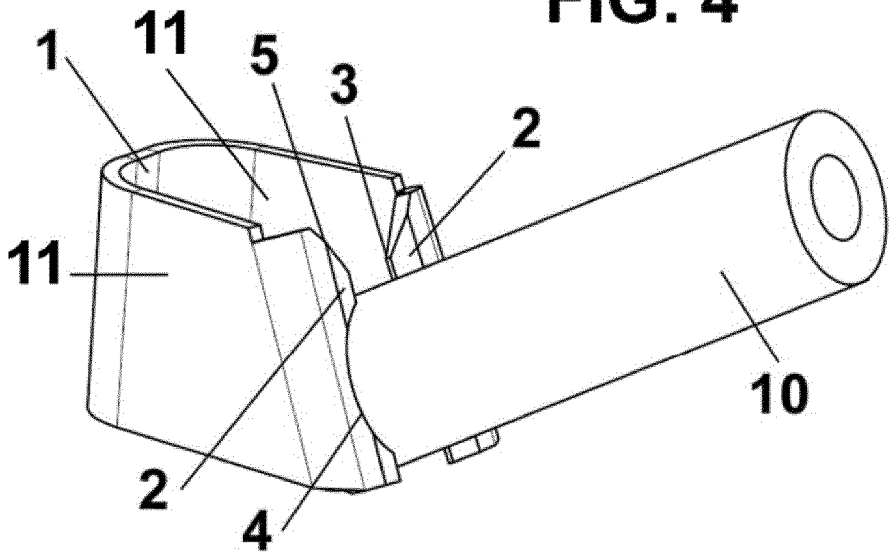
FIG. 4 is a perspective view of a second embodiment of the electrical contact according to the present invention with the cable in the holding and connection position thereof.

In the FIGS. 3 and 4, a second embodiment of the electrical contact for electrical cables according to the present invention is depicted. For reasons of simplicity, in this second embodiment, the same reference numerals are used to indicate the same elements as in the previous embodiment.

In this embodiment, the base (1) is a substantially flat surface, which serves as a joining for the cutting and connection elements (2) by way of the arms (11) thereof. The cutting and connection elements (2) also comprise an initial cutting edge (3) and a cutting and connection portion (4), the initial cutting edge (3) being closer to the base than the cutting and connection portion (4).

Furthermore, in this embodiment, the electrical contact for the electrical cables also comprises two arms (11) which extend from the base (1) defining a U shape, a cutting and connection element (2) extending from each arm towards the interior of the electrical contact in a substantially perpendicular manner, although in this case from the end of the arm (11) furthest from the base.

In this embodiment, the initial cutting edge (3) is also associated with a mouth (5) for the electrical cable (10). Also in this embodiment, the cutting of the cover of the electrical cable (10) is carried out, defining a rotational movement, as is indicated by means of the arrow of FIG. 3.

Figure 5:
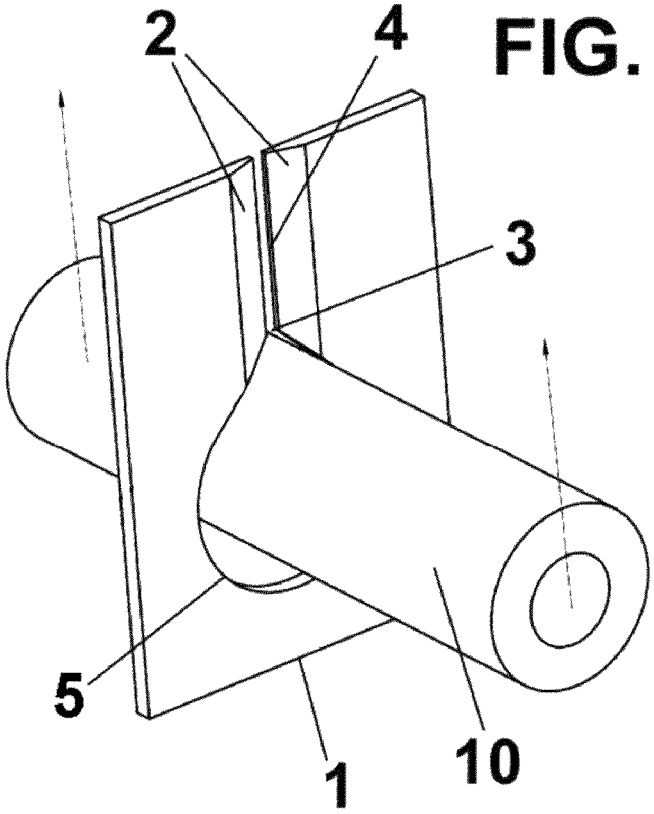
FIG. 5 is a perspective view of a third embodiment of the electrical contact according to the present invention with the cable in the initial cutting position thereof.
Figure 6:
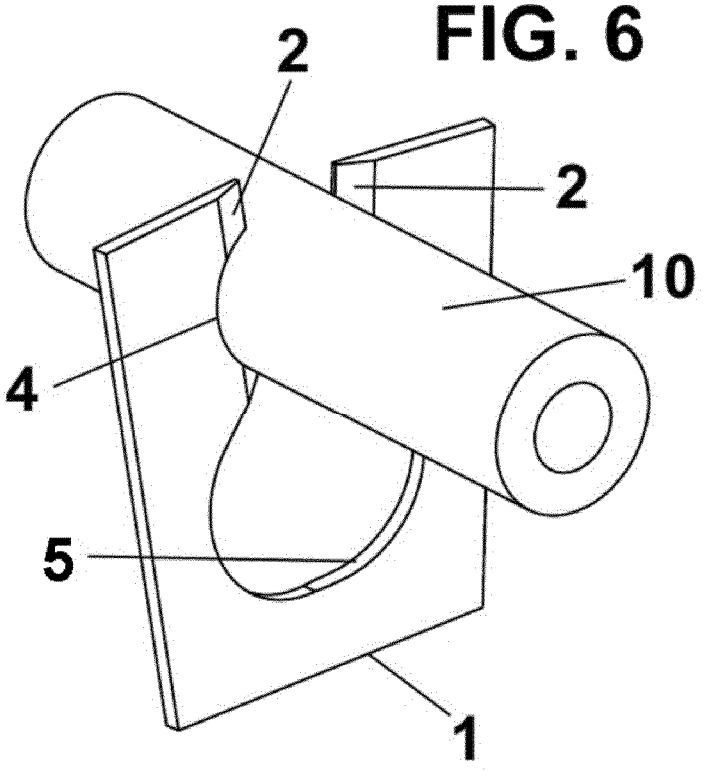
FIG. 6 is a perspective view of a third embodiment of the electrical contact according to the present invention with the cable in the holding and connection position thereof.

In the FIGS. 5 and 6, a third embodiment of the electrical contact for electrical cables according to the present invention is depicted. For reasons of simplicity, in this third embodiment, the same reference numerals are used to indicate the same elements as in the previous embodiments.

In this embodiment, the base (1) is an edge of the electrical contact and the principal different is that the electrical contact has a plate shape and the mouth (5) is a hole associated with the initial cutting edge (3). This hole is substantially circular and the diameter thereof is greater than the diameter of the electrical cable whose cover is desired to be cut.

In this embodiment, the displacement of the electrical cable (10) from the initial cutting edge (3) to the cutting and connection portion (4) is translational.

As in the previous embodiments, the distance of the initial cutting edge (3) to the base (1) is less than the distance of the cutting and connection portion (4) to the base (1).

The functioning of the electrical contact of the present invention is the same in the three embodiments. Firstly, the electrical cable (10) should be placed facing the initial cutting edge (3), which is facilitated owing the mouth (5).

Then the user displaces the electrical cable (10), initiating the cutting of the cover thereof on the initial cutting edge (3), a time at which the maximum force is applied.

Once the cutting has been initiated, the electrical cable (10) continues being displaced towards the cutting and connection portion (4), but applying less force.

Once placed in this cutting and connection position (4), the cover of the electrical cable (10) will be completely cut, the electrical connection being carried out.

In spite of the fact that reference has been made to specific embodiments of the invention, it is evident to a person skilled in the art that the electrical contact for electrical cables described is capable of having numerous variations and modifications, and that all the details mentioned can be replaced for others which are technically equivalent without departing from the scope of protection defined by the attached claims.

The invention claimed is:

1. An electrical contact for electrical cables, comprising a base, at least one cutting and connection element, the at least one cutting and connection element defining an initial cutting edge and a cutting and connection portion, said initial cutting edge being closer to the base than said cutting and connection portion; and two arms extending from the base defining a U shape, wherein the at least one cutting and connection element extends from each arm towards an interior of the electrical contact, wherein each cutting and connection element is arranged at the end of each arm furthest from the base.

2. The electrical contact for electrical cables according to claim 1, wherein each of the at least one cutting and connection element extends from the part furthest from the base of each arm.

3. The electrical contact for electrical cables according to claim 1, wherein each of the at least one cutting and connection element extends from each arm in a substantially perpendicular manner.

4. The electrical contact for electrical cables according to claim 1, wherein each arm has an arched shape.

5. The electrical contact for electrical cables according to claim 1, wherein each of the at least one cutting and connection element define a plane which forms an acute angle with said base.

6. The electrical contact for electrical cables according to claim 1, wherein each of the at least one cutting and connection element comprises a knurling.

7. The electrical contact for electrical cables according to claim 1, wherein the initial cutting edge comprises a mouth for the placement of an electrical cable.

8. The electrical contact for electrical cables according to claim 7, wherein the mouth is a hole for introducing the electrical cable.

* * * * *